US006209146B1

(12) United States Patent
Gonzalez

(10) Patent No.: US 6,209,146 B1
(45) Date of Patent: Apr. 3, 2001

(54) VENTILATION DEVICE FOR A TOILET

(76) Inventor: Arturo Gonzalez, 11104 Avenue M, Chicago, IL (US) 60617

( * ) Notice: Subject to any disclaimer, the term of this patent is extended or adjusted under 35 U.S.C. 154(b) by 0 days.

(21) Appl. No.: 09/536,908

(22) Filed: Mar. 28, 2000

Related U.S. Application Data

(60) Provisional application No. 60/127,047, filed on Mar. 31, 1999.

(51) Int. Cl.[7] ..... E03D 9/04

(52) U.S. Cl. ..... 4/213; 4/216; 4/217; 4/209 R

(58) Field of Search ..... 4/213, 216, 217, 4/218, 209 R, 353, 340, 341, 363, 364

(56) References Cited

U.S. PATENT DOCUMENTS

| | | | | |
|---|---|---|---|---|
| 3,491,382 | * | 1/1970 | Poister . | |
| 3,849,808 | * | 11/1974 | Olson et al. . | |
| 4,174,589 | * | 11/1979 | Daharsh | 4/353 |
| 4,932,084 | * | 6/1990 | Hanson | 4/353 |
| 5,345,617 | * | 9/1994 | Jahner et al. | 4/217 |
| 5,452,481 | * | 9/1995 | Meyer | 4/213 |
| 5,727,262 | * | 3/1998 | Littlejohn | 4/213 |
| 6,003,157 | * | 12/1999 | Bruyere | 4/213 |

FOREIGN PATENT DOCUMENTS

| | | | | |
|---|---|---|---|---|
| 976026 | * | 5/1963 | (GB) | 4/213 |
| 2212827 | * | 8/1989 | (GB) | 4/213 |

* cited by examiner

*Primary Examiner*—Henry J. Reclua
*Assistant Examiner*—Khoa D. Huynh
(74) *Attorney, Agent, or Firm*—Goldstein & Canino

(57) ABSTRACT

A ventilation device for a toilet including a duct having an open upper end and an open lower end. The open lower end is positioned below a toilet seat of a toilet and directed towards an interior of a toilet bowl of the toilet. The open upper end is positioned on an upper end a tank of the toilet. A ventilation system is secured to the upper end of the tank of the toilet. The ventilation system includes a container having an open lower end in communication with the open upper end of the duct. The container has an open upper end. The open upper end of the container has an ornamental plant disposed therein. The container has a motorized fan disposed therein.

4 Claims, 2 Drawing Sheets

VENTILATION DEVICE FOR A TOILET

CROSS REFERENCES AND RELATED SUBJECT MATTER

This application relates to subject matter contained in provisional patent application Ser. No. 60/127,047, filed in the United States Patent & Trademark Office on Mar. 31, 1999.

BACKGROUND OF THE INVENTION

The present invention relates to a ventilation device for a toilet and more particularly pertains to removing unpleasant odors from a toilet while being disguised in appearance.

In most toilets and bathrooms, there is a frequent problem associated with ventilation of odors attendant to the use of the toilet. In some instance, the bathroom itself is equipped with a ceiling vent which draws odors out of the bathroom. However, this solution for controlling odor is frequently inadequate because very large volumes of room air must be exhausted in order to dissipate odors that are actually concentrated in and about the toilet bowl. There have been a number of attempts to devise a device which can remove or treat the odors in and about the toilet bowl, itself, rather than the bathroom environment in general. Many of these devices are large and bulky and generally not aesthetically pleasing. The present invention attempts to provide a device which will remove unpleasant odors from the toilet while at the same time is aesthetically pleasing to the user.

The use of bathroom air freshening devices is known in the prior art. More specifically comprised of an internal duct and means to release perfume whenever a user sits upon the seat. U.S. Pat. No. 4,670,916 to Bloom discloses a toilet bowl deodorant dispenser activated by the movement of the toilet seat. U.S. Pat. No. 4,933,996 to Sowards and U.S. Pat. No. 4,153,956 to Fischer, Sr. disclose toilet bowl deodorizing devices.

While these devices fulfill their respective, particular objective and requirements, the aforementioned patents do not describe a ventilation device for a toilet for removing unpleasant odors from a toilet while being disguised in appearance.

In this respect, the ventilation device for a toilet according to the present invention substantially departs from the conventional concepts and designs of the prior art, and in doing so provides an apparatus primarily developed for the purpose of removing unpleasant odors from a toilet while being disguised in appearance.

Therefore, it can be appreciated that there exists a continuing need for new and improved ventilation device for a toilet which can be used for removing unpleasant odors from a toilet while being disguised in appearance. In this regard, the present invention substantially fulfills this need.

SUMMARY OF THE INVENTION

In the view of the foregoing disadvantages inherent in the known types of bathroom air freshening devices now present in the prior art, the present invention provides an improved ventilation device for a toilet. As such, the general purpose of the present invention, which will be described subsequently in greater detail, is to provide a new and improved ventilation device for a toilet and method which has all the advantages of the prior art and none of the disadvantages.

To attain this, the present invention essentially comprises a duct having an open upper end and an open lower end. The open lower end is positioned below a toilet seat of a toilet and directed towards an interior of a toilet bowl of the toilet. The open upper end is positioned on an upper end a tank of the toilet. A ventilation system is secured to the upper end of the tank of the toilet. The ventilation system includes a container having an open lower end in communication with the open upper end of the duct. The container has an open upper end. The open upper end of the container has an ornamental plant disposed therein. The container has a motorized fan disposed therein. The open lower end of the container has a filter disposed therein. A variable speed switch is disposed within a front face of the container of the ventilation system. The variable speed switch is in communication with the motorized fan. A motion sensor is disposed within the front face of the container of the ventilation system. The motion sensor is in communication with the motorized fan.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved ventilation device for a toilet which has all the advantages of the prior art bathroom air freshening devices and none of the disadvantages.

It is another object of the present invention to provide a new and improved ventilation device for a toilet which may be easily and efficiently manufactured and marketed.

It is a further object of the present invention to provide a new and improved ventilation device for a toilet which is of durable and reliable construction.

An even further object of the present invention is to provide a new and improved ventilation device for a toilet which is susceptible of a low cost of manufacture with regard to both materials and labor, and which accordingly is then susceptible of low prices of sale to the consuming public, thereby making such a ventilation device for a toilet economically available to the buying public.

Even still another object of the present invention is to provide a new and improved ventilation device for a toilet for removing unpleasant odors from a toilet while being disguised in appearance.

Lastly, it is an object of the present invention to provide a new and improved ventilation device for a toilet including a duct having an open upper end and an open lower end. The open lower end is positioned below a toilet seat of a toilet and directed towards an interior of a toilet bowl of the toilet. The open upper end is positioned on an upper end a tank of the toilet. A ventilation system is secured to the upper end of the tank of the toilet. The ventilation system includes a container having an open lower end in communication with the open upper end of the duct. The container has an open upper end. The open upper end of the container has an ornamental plant disposed therein. The container has a motorized fan disposed therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
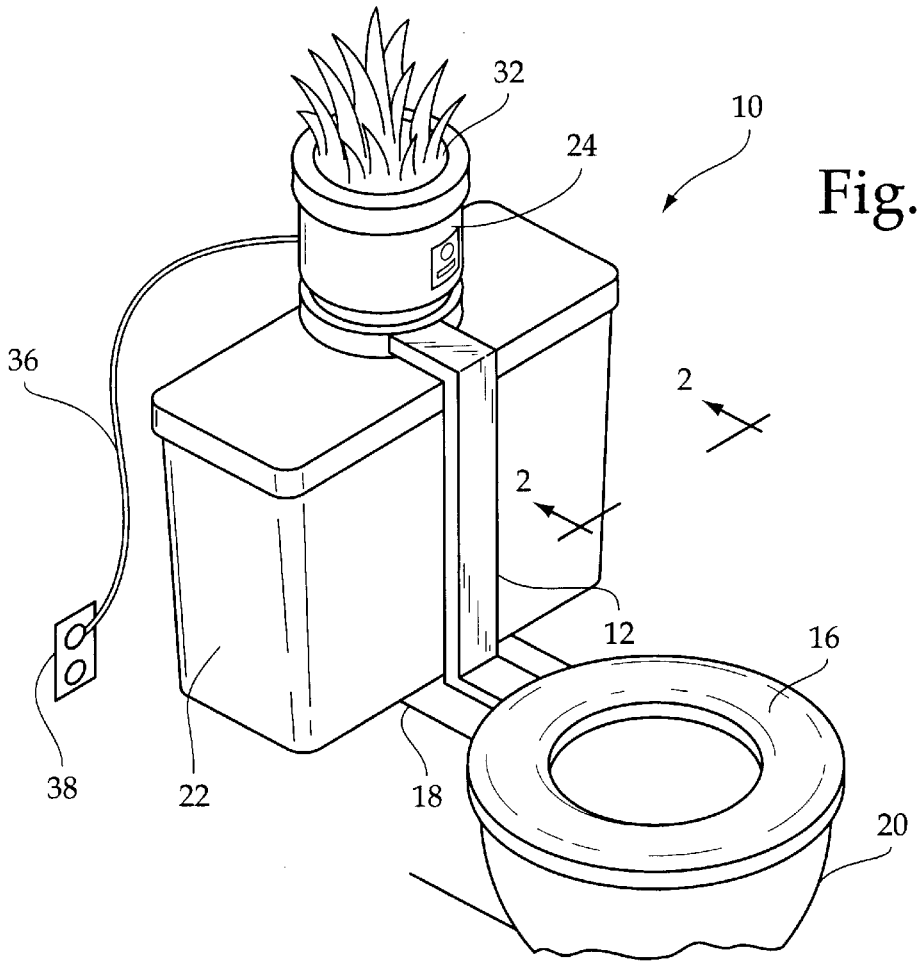
FIG. 1 is a perspective view of the preferred embodiment of the ventilation device for a toilet constructed in accordance with the principles of the present invention.
Figure 2:
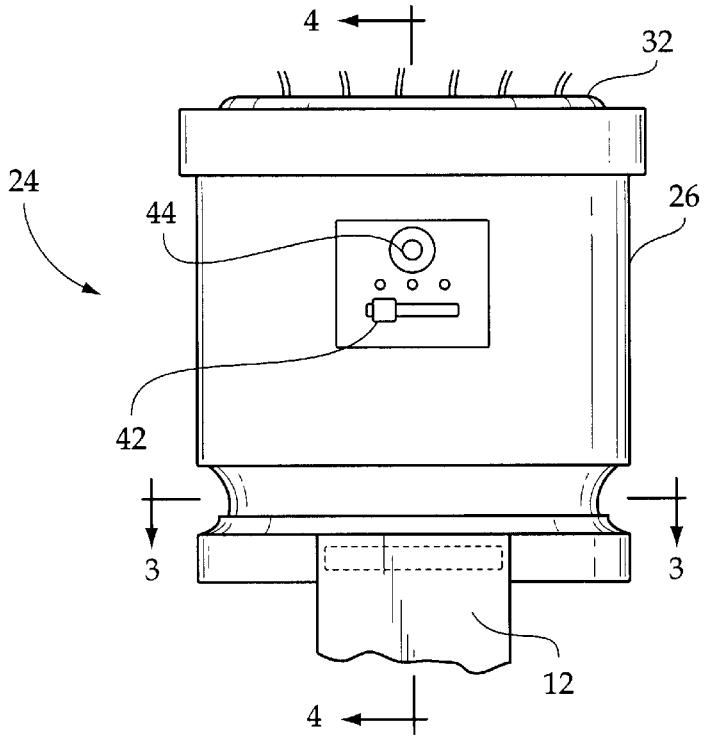
FIG. 2 is a front view of the present invention as taken along line 2—2 of FIG. 1.
Figure 3:
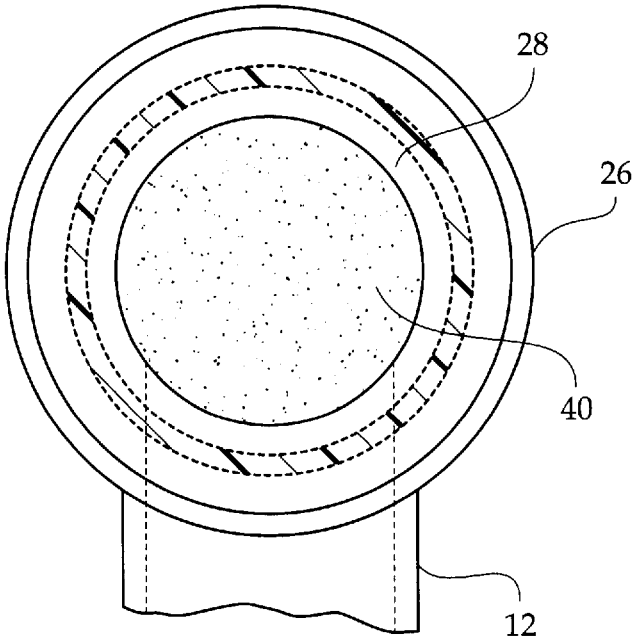
FIG. 3 is a cross-sectional view of the present invention as taken along line 3—3 of FIG. 2.
Figure 4:
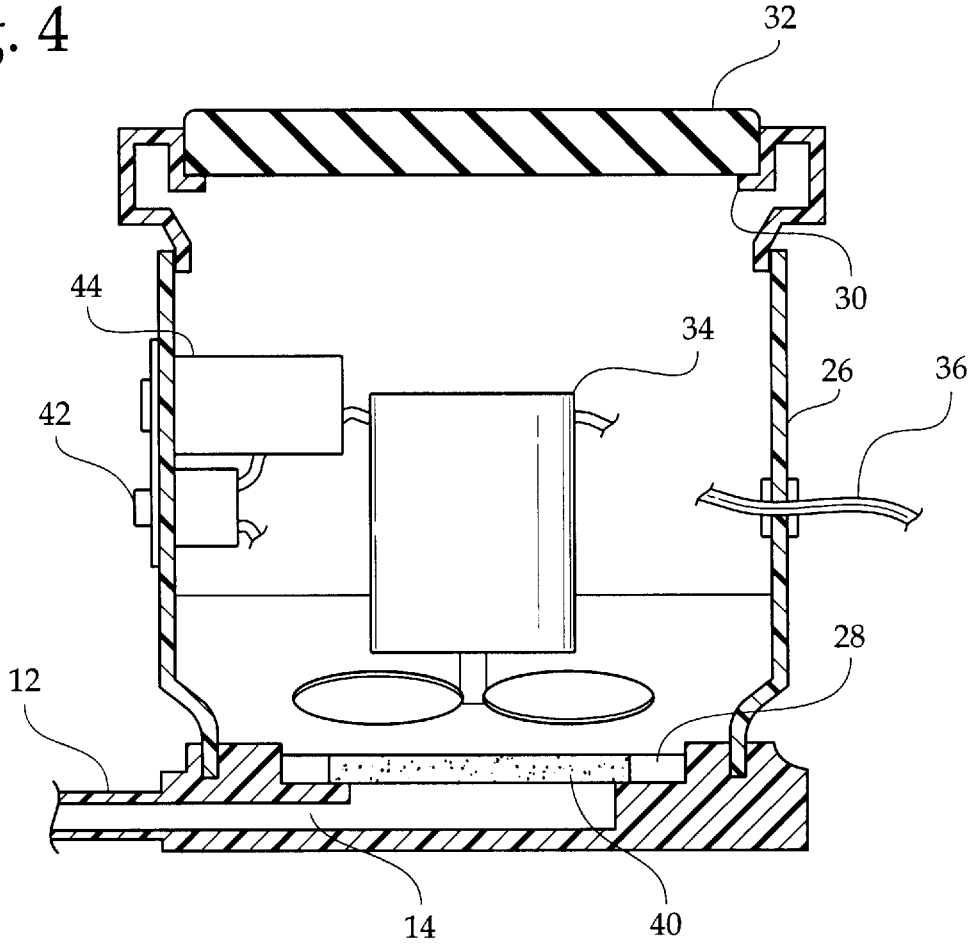
FIG. 4 is a cross-sectional view of the present invention as taken along line 4—4 of FIG. 2.

With reference now to the drawings, and in particular, to FIGS. 1 through 4 thereof, the preferred embodiment of the new and improved ventilation device for a toilet embodying the principles and concepts of the present invention and generally designated by the reference number 10 will be described.

Specifically, it will be noted in the various Figures that the device relates to a ventilation device for a toilet for removing unpleasant odors from a toilet while being disguised in appearance. In its broadest context, the device consists of a duct, a ventilation system, a variable speed switch, and a motion sensor. Such components are individually configured and correlated with respect to each other so as to attain the desired objective.

The duct 12 has an open upper end 14 and an open lower end. The open lower end is positioned below a toilet seat 16 of a toilet 18 and directed towards an interior of a toilet bowl 20 of the toilet 18. The open upper end 14 is positioned on an upper end a tank 22 of the toilet 18.

The ventilation system 24 is secured to the upper end of the tank 22 of the toilet 18. The ventilation system 24 includes a container 26 having an open lower end 28 in communication with the open upper end 14 of the duct 12. The container 26 has an open upper end 30. The open upper end 30 of the container 26 has an ornamental plant 32 disposed therein. The container 26 has a motorized fan 34 disposed therein. The motorized fan 34 is powered via the use of an electric plug 36 that is coupled with an existing electrical outlet 38. Note FIG. 1. The open lower end 28 of the container 26 has a filter 40 disposed therein.

The variable speed switch 42 is disposed within a front face of the container 26 of the ventilation system 24. The variable speed switch 42 is in communication with the motorized fan 34. The variable speed switch 42 will be provided with at least three settings to vary the speed of the fan 34.

The motion sensor 44 is disposed within the front face of the container 26 of the ventilation system 24. The motion sensor 44 is in communication with the motorized fan 34. The motion sensor 44 will activate the fan 34 once the presence of an individual is detected. The motion sensor 44 will additionally deactivate the fan 34 after a predetermined amount of time has lapsed where there has been no detectable movement.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A ventilation device for a toilet for removing unpleasant odors from a toilet while being disguised in appearance comprising, in combination:

a duct having an open upper end and an open lower end, the open lower end being positioned below a toilet seat of a toilet and directed towards an interior of a toilet bowl of the toilet, the open upper end being positioned on an upper end of a tank of the toilet, the tank having a tank lid;

a ventilation system mounted on top of the lid of the tank of the toilet, the ventilation system including a container having an open lower end in communication with the open upper end of the duct, the container having an open upper end, the open upper end of the container having an ornamental plant disposed therein, the container having a motorized fan disposed therein, the open lower end of the container having a filter disposed therein;

a variable speed switch disposed within a front face of the container of the ventilation system, the variable speed switch being in communication with the motorized fan;

a motion sensor disposed within the front face of the container of the ventilation system, the motion sensor being in communication with the motorized fan.

2. A ventilation device for a toilet for removing unpleasant odors from a toilet while being disguised in appearance comprising, in combination:

a duct having an open upper end and an open lower end, the open lower end being positioned below a toilet seat of a toilet and directed towards an interior of a toilet bowl of the toilet, the open upper end being positioned on an upper end of a tank of the toilet, the tank having a tank lid;

a ventilation system mounted on top of the lid of the tank of the toilet, the ventilation system including a container having an open lower end in communication with the open upper end of the duct, the container having an open upper end, the open upper end of the container having an ornamental plant disposed therein, the container having a motorized fan disposed therein.

3. The ventilation device for a toilet as set forth in claim 2 wherein the open lower end of the container has a filter disposed therein.

4. The ventilation device for a toilet as set forth in claim 2 and further including a variable speed switch disposed within a front face of the container of the ventilation system, the variable speed switch being in communication with the motorized fan.

* * * * *